United States Patent [19]

Nelson

[11] 4,295,299

[45] Oct. 20, 1981

[54] STEEL CLAD WOOD DOOR FRAME

[75] Inventor: David M. Nelson, Kewanee, Ill.

[73] Assignee: United States Gypsum Company, Chicago, Ill.

[21] Appl. No.: 83,133

[22] Filed: Oct. 9, 1979

[51] Int. Cl.[3] ..... E06B 1/04

[52] U.S. Cl. ..... 49/504; 52/514; 292/346

[58] Field of Search ..... 49/503, 504, 460; 70/542; 292/346; 52/514

[56] References Cited

U.S. PATENT DOCUMENTS

| | | | |
|---|---|---|---|
| 3,290,081 | 12/1966 | Sushan | 292/346 |
| 3,662,494 | 5/1972 | Sitterly | 49/504 |
| 3,918,207 | 11/1975 | Aliotta | 52/514 X |
| 4,154,034 | 5/1979 | Bursk et al. | 49/504 X |

*Primary Examiner*—Kenneth Downey

*Attorney, Agent, or Firm*—Samuel Kurlandsky; Robert H. Robinson; Kenneth E. Roberts

[57] ABSTRACT

A door frame comprising wood frame members including a strike jamb, a hinge jamb, and a header, said frame members each being recessed longitudinally to provide a rabbet having a major surface and a minor surface perpendicular to said major surface, a slot substantially coplanar with the major surface of said rabbet extending into a non-recessed portion of said member, and a substantially J-shaped metal frame reinforcing member having a major flange, a minor flange substantially parallel to said major flange, and a connecting web substantially perpendicular to said major and minor flanges, said minor flange engaging the major surface of said rabbet and extending into said slot, and the major flange of said reinforcing member extending in engagement with the outer surface of said member.

6 Claims, 3 Drawing Figures

STEEL CLAD WOOD DOOR FRAME

BACKGROUND OF THE INVENTION (1) Field of the Invention

The present invention relates to doors, and is more particularly concerned with a door frame constructed primarily of wood, and having a metal cladding surrounding a portion of the frame.

(2) Prior Art

It has been conventional to construct door frames of wood. Wood frames are easy to construct and provide good thermal insulation. However, wood is not as strong as might be desired, and a large percentage of forced entries are gained through failure of the wood frame. More recently door frames made entirely of steel have appeared on the market. The use of steel solves the security problem, but results in thermal problems because of the fact that steel conducts exterior temperatures to the interior of the dwelling. Steel reinforced wood frames have entered the market and add some rigidity to the entire frame, but these frames have provided no protection in the lock and hinge areas.

SUMMARY OF THE INVENTION

It is therefore an object of the invention to provide a door frame formed primarily of wood in order to provide good thermal insulation.

It is another object of the invention to provide a door of the type described in which protection is provided against forced entry in the areas of the lock and hinges.

It is further an object to provide a door frame of the type described which may be readily constructed of available materials and which is relatively inexpensive to produce.

Still other objects and advantages of the invention will readily present themselves to one skilled in the art upon reference to the following specification, the drawings, and the claims.

According to the invention, a door frame is provided formed primarily of wood frame members including a strike jamb, a hinge jamb, and a header. Each frame member is recessed to form a rabbet for receiving the edges the door in the closed position. A metal cladding, preferably of sheet steel is provided around portions of the rabbeted areas, and particularly in the lock area and the hinge area. As a result, the door retains its thermal insulation properties, yet offers excellent protection against forced entry.

DESCRIPTION OF THE PREFERRED EMBODIMENT

Figure 1:
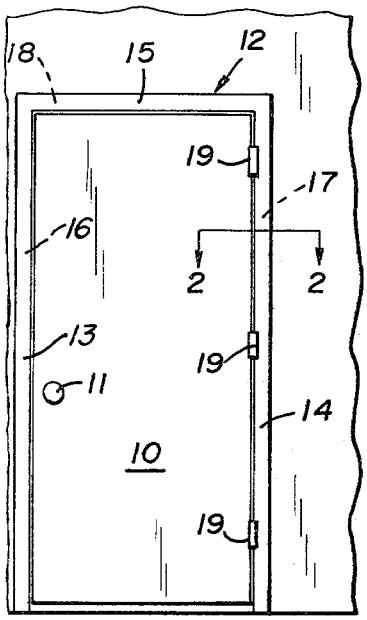
FIG. 1 is an elevational view of a door and frame according to the invention.

Referring to FIG. 1, a door 10 having a knob 11 is shown mounted in a door frame 12. The door frame 12 comprises interior trim moldings 13, 14 and 15 which cover a strike jamb 16, a hinge jamb 17, and a header 18, respectively. The jamb and header structures are not visible in FIG. 1. The door 10 is hingedly mounted on the frame 12 by means of hinges 19.

Figure 2:
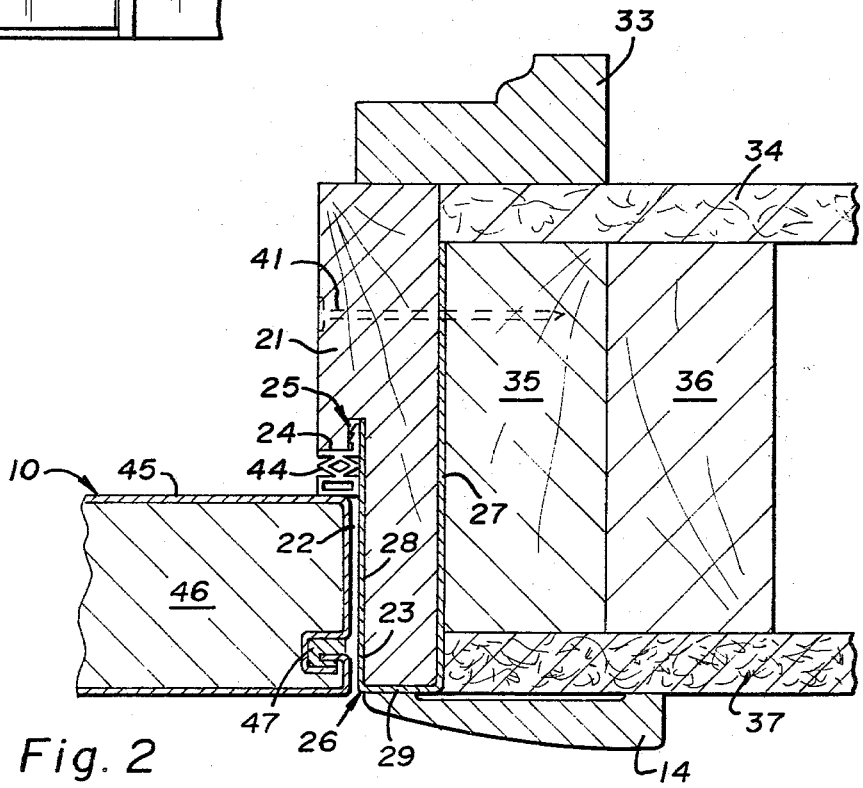
FIG. 2 is a fragmentary cross-sectional view taken at the line 2—2 of FIG. 1, looking in the direction of the arrows.
Figure 3:
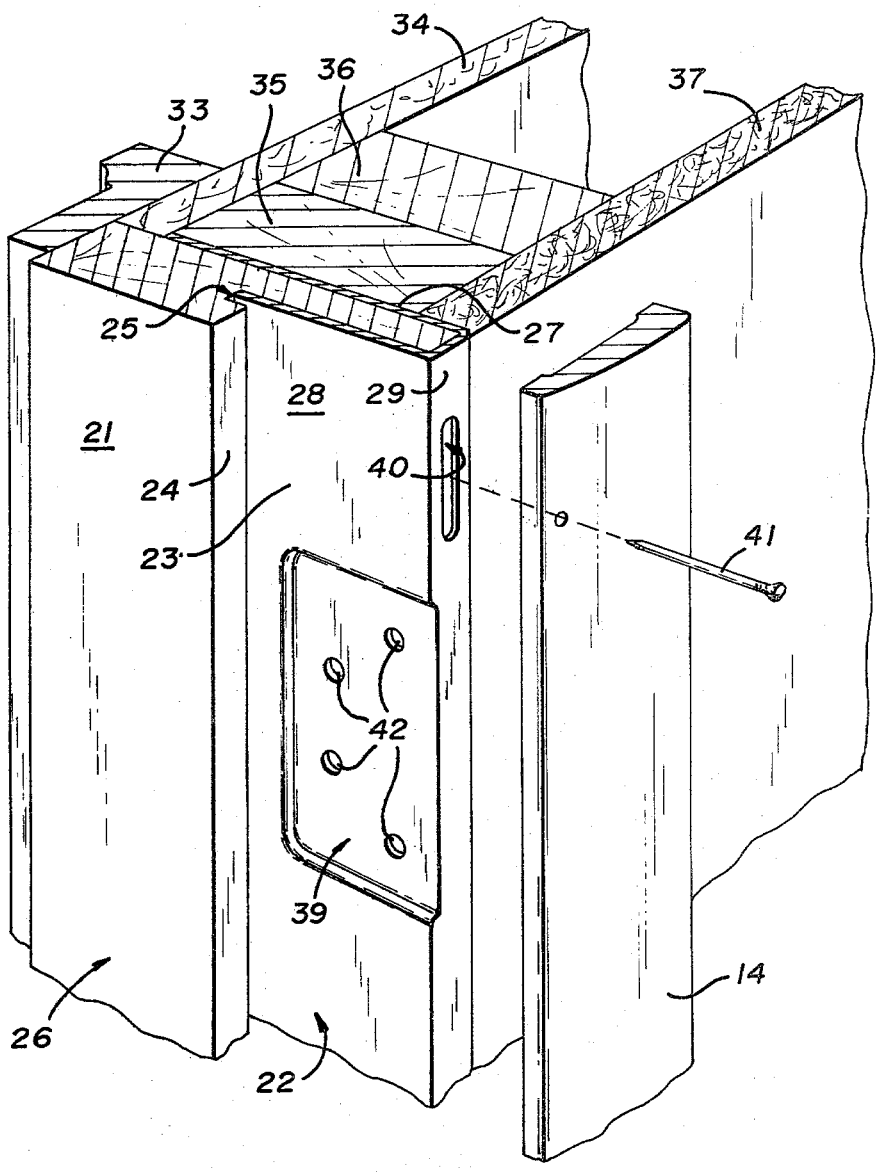
FIG. 3 is a perspective view of the hinge jamb and associated structures.

Referring to FIGS. 2 and 3, portions of the hinge jamb are shown in detail. Since cross-sectional views of the strike jamb 16 and header 18 are almost identical to that shown in FIGS. 2 and 3, these structures are not shown in the drawings in detail. The hinge jamb is comprised of a wood base 21 which is recessed longitudinally to provide a rabbet 22 having a major face 23 and a minor face 24. A slot 25 is provided substantially coplanar with the major face of the rabbet, and extending a limited distance into the non-rabbeted portion of the wood base 21.

In order to provide protection against forced entry, a J-shaped metal cladding or reinforcing frame 26 is mounted over the rabbeted portion of the wood base 21 and comprises a major flange 27, a minor flange 28 and a connecting web 29 which covers the inner exposed edge of the hinge jamb. The reinforcing frame 26 is so arranged that the major flange is in contact engagement with the unrabbeted surface of the wood base 21 and the minor flange is in contact engagement with the major face 23 of the rabbet 22 and extends into the slot 25. The connecting web 29 forms the edge of the hinge jamb 17.

The remainder of the building structure to which the jamb is attached comprises a brick molding 33, an outer sheeting 34, wood studs 35 and 36, and a sheet of dry wall 37. Interior trim 16 covers the connecting web 29 and laps over the dry wall 37.

Referring to FIG. 3, a hinge recess 39 is shown provided in the minor flange 28 of the reinforcing frame. A nail slot 40 is shown provided in the connecting web 29 to permit nails 41 to pass therethrough and to engage the wood portion of the hinge jamb 17. Other slots, not shown, may be provided in the reinforcing frame 26 to permit nails to pass into stud 35, as shown in FIG. 2.

In FIG. 2 the door 10 is shown positioned in the space defined by the rabbet 22, and includes a metal skin 45 and a plastic foam core 46. A vinyl thermal break 47 is provided to fasten the free edges of the metal skin and to prevent heat from being transferred from one skin to the other. Flexible vinyl compression type weatherstripping 44 is affixed to the minor surface 24 of the rabbet 22 to provide thermal insulation when engaged by the door 10. Magnetic type weatherstripping may be affixed in similar manner to the strike jamb.

The door frame of the present invention has several advantages over existing door frames. First, it utilizes primarily wood jambs which are easy to construct and which provide good thermal insulation. Second, by providing a steel reinforcement frame over the portion of the jambs subject to forced entry, it provides the jambs with sufficient strength to prevent such forced entry. In order to gain illegal entry through the door, a person would have to deform the steel reinforcing security frame instead of merely breaking out the wood frame. In the present structure the steel encloses the wood of the jamb starting at the top, extending across the jamb face, bending around the interior edge of the frame, and extending approximately $\frac{3}{4}$ of the way across the underside of the frame. The frame is attached to the rough opening through the outer layer of steel, thus securing the frame in the opening. The lock strike plate and hinges are attached through the outer layer of steel and into the wood, thus anchoring them to the steel and frame. Since no steel is exposed to exterior temperatures, there is no thermal problem involved. In practice the steel reinforcing members may extend the entire length of each jamb. Alternatively, the reinforcing members may be placed solely in the areas of the lock and the hinges.

It is to be understood that the invention is not to be limited to the exact details of construction or operations or materials shown and described, as obvious modifications and equivalents will be apparent to one skilled in the art.

Invention is claimed as follows:

1. A door frame comprising wood frame members including a strike jamb, a hinge jamb, and a header, said frame members each being recessed longitudinally to provide a rabbet having a major surface and a minor surface perpendicular to said major surface, a slot substantially coplanar with a major surface of said rabbet extending into a non-recessed portion of said member and along substantially the entire length of said member, and a substantially J-shaped metal frame reinforcing member extending along substantially the entire length of said member and having a major flange, a minor flange substantially parallel to said major flange, and a connecting web substantially perpendicular to said major and minor flanges, said minor flange engaging the major surface of said rabbet and extending into said slot, and the major flange of said reinforcing member extending in engagement with the outer surface of said member.

2. A door frame according to claim 1, wherein the metal of which said reinforcing member is made is steel.

3. A door frame according to claim 2, wherein said metal reinforcing member is provided with openings to permit nails to pass therethrough.

4. A door frame according to claim 2, wherein decorative molding strips cover the edges of each of said members.

5. A door frame according to claim 2, wherein the minor face of the rabbet of said strike jamb has a magnetic weatherstripping affixed thereto, and the minor face of the rabbet of said hinge jamb has a compressible weatherstripping affixed thereto.

6. A door frame according to claim 2, wherein the minor flange of said reinforcing member is recessed for receiving a hinge flush-mounted therein.

* * * * *